United States Patent [19]

Verbiar et al.

[11] Patent Number: 4,976,084

[45] Date of Patent: Dec. 11, 1990

[54] FURRING AND METHOD OF APPLING SAME

[76] Inventors: Clifford P. Verbiar, 6 Harrison Ave., Centereach, N.Y. 11720; Richard Cote, 11 Adrienne Dr., Old Bethpage, N.Y. 11804

[21] Appl. No.: 433,168

[22] Filed: Nov. 8, 1989

[51] Int. Cl.[5] ..... E04B 1/38

[52] U.S. Cl. ..... 52/713; 52/727; 52/DIG. 8; 52/745

[58] Field of Search ..... 52/727, DIG. 8, 728, 52/713, 745; 248/228

[56] References Cited

U.S. PATENT DOCUMENTS

| | | | |
|---|---|---|---|
| 1,813,873 | 7/1931 | Brogden | 52/727 X |
| 3,748,815 | 7/1973 | Parker . | |
| 3,998,028 | 12/1976 | Pelletier et al. . | |
| 4,019,301 | 4/1977 | Fox | 52/727 X |
| 4,043,092 | 9/1977 | Paul et al. . | |
| 4,484,427 | 11/1984 | Crites et al. . | |
| 4,592,187 | 6/1986 | Crites et al. . | |

FOREIGN PATENT DOCUMENTS

| | | | |
|---|---|---|---|
| 2519166 | 11/1976 | Fed. Rep. of Germany | 248/228 |
| 773218 | 10/1980 | U.S.S.R. . | |
| 2041055 | 9/1980 | United Kingdom . | |
| 2041433 | 9/1980 | United Kingdom . | |
| 2042034 | 9/1980 | United Kingdom . | |

*Primary Examiner*—Richard E. Chilcot, Jr.
*Assistant Examiner*—Lan Mai
*Attorney, Agent, or Firm*—Watson, Cole, Grindle & Watson

[57] ABSTRACT

A furring apparatus is provided which comprises two U-shaped members, each having first and second ends and a channel formed on its inner surface. A spring retainer is located on each second end, whereby the second end of one U-shaped member may be inserted into and engaged with the first end of the other U-shaped member. Accordingly, a ring may be formed about the column to which wallboard may be secured. Each U-shaped member comprises two L-shaped members joined together via a spring retainer as discussed previously. An L-shaped member is formed by bending an initially straight member 90° along a bend line. The present invention allows for economically produced furring to be quickly and efficiently mounted on a beam via self-tapping screws, thereby expediting the installation of wallboard.

21 Claims, 2 Drawing Sheets

FURRING AND METHOD OF APPLING SAME

BACKGROUND OF THE INVENTION

1. Technical Field of the Invention

The present invention relates to wall construction and more particularly to a furring apparatus and method.

2. Discussion of the Related Art

Nearly all commercial construction utilizes some form of structural steel or other materials for perimeter and/or interior support. Typical supports include web and flange steel columns, e.g., having an overall 8"×8" cross-section, and round lolly columns. After installing these supports, furring is attached, e.g., the supports are boxed in with conventional gypsum sheet rock wallboard.

A wide range of methods have been employed to secure this furring. For example, the sheet rock is adhesively bonded to the columns or screwed into holes drilled into the columns. Alternatively, wood 2×4's are forcibly wedged between the column flanges and the sheet rock is then screwed to the wood. In addition, metal furring is attached to the columns via powder actuated fastener guns. The sheet rock is then screwed to the metal furring. Finally, pieces of sheet rock are joined together via angle iron and then wrapped around the column.

These techniques all suffer the drawback of being time consuming. In addition, none of the techniques takes advantage of metal studs and self-tapping power driven screws.

Accordingly, it is an object of the present invention to provide a furring apparatus and method which may be quickly deployed and installed.

It is a further object of the present invention to provide a furring apparatus and method which permits the use of self-tapping screws.

Other objects and advantages will become apparent from the specification and drawings which follow.

SUMMARY OF THE INVENTION

The foregoing and additional objects are achieved by a furring apparatus according to the present invention. First and second U-shaped members are provided, each having first and second ends and a channel formed on its inner face. Means are provided for engaging the first end of the first U-shaped member with the second end of the second U-shaped member. In addition, means are provided for engaging the first end of the second U-shaped member with the second end of the first U-shaped member. Accordingly, the two U-shaped members may surround a column such that their ends engage to form a rectangular ring about the column. Wallboard may then be secured to the rectangular ring.

Each U-shaped member may comprise two L-shaped members which are engaged at respective ends to form a U-shaped member. These L-shaped members may be formed by bending straight members along a bend-line.

The L-shaped and U-shaped members may be respectively engaged by inserting a second end equipped with a spring retainer into an open first end.

DETAILED DESCRIPTION OF THE PREFERRED EMBODIMENTS

Figure 1:
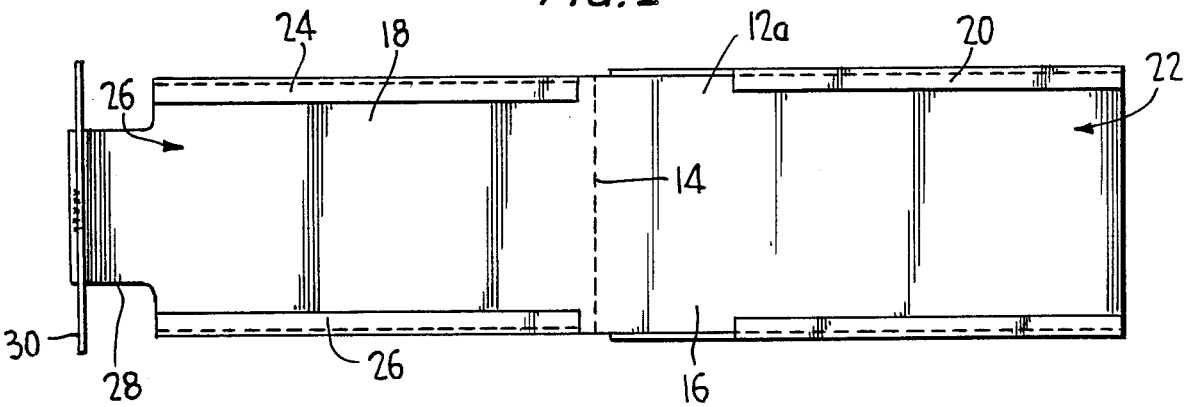
FIG. 1 is a top pictorial view of a straight member according to the present invention.

The present invention will now be discussed in detail with reference to the accompanying drawings. Referring to FIG. 1, a straight member 12*a* is divided by a bend line 14 into a first portion 16 and a second portion 18. First portion 16 has flanges 20 on opposing edges which form open ended, three-walled channels 22. Similarly, second portion 18 has flanges 24 on opposing edges which form three-walled channels 26. Note that first portion 16 is wider than second portion 18 to allow engagement, as discussed more fully below. In addition, second portion 18 has a tongue section 28 with a spring retainer 30.

Figure 2:
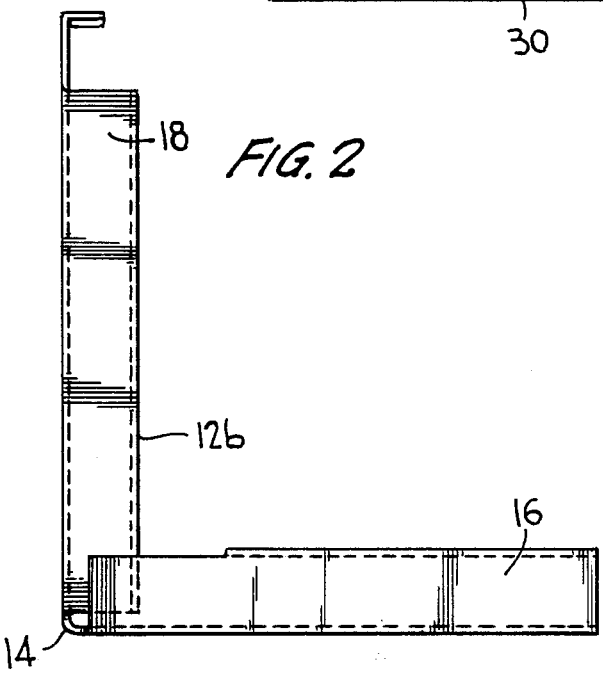
FIG. 2 is a side pictorial view of an L-shaped member according to the present invention.

As seen in FIG. 2, straight member 12*a* may be bent approximately 90° along bend line 14 to form L-shaped member 12*b* such that the channels 22 and 26 are located along the inner face of the L-shaped member. Straight member 12*a* may be composed of any suitable material such as steel or the like which allows bending along the bend line 14 as well as possesses sufficient strength to support wallboard as discussed below. Of course, one skilled in the art would attempt to minimize manufacturing costs while maximizing these characteristics.

Figure 3:
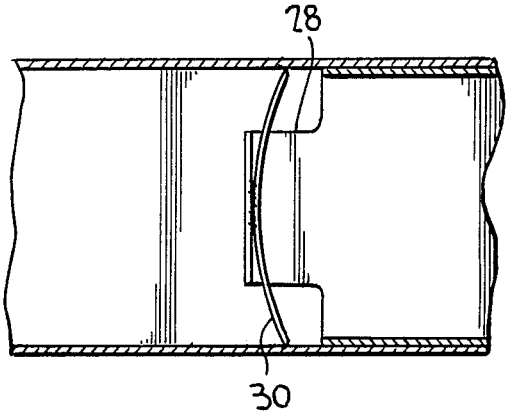
FIG. 3 is an exposed side view of the engaged ends of the furring segments taken along line 3—3 of FIG. 5.
Figure 4:
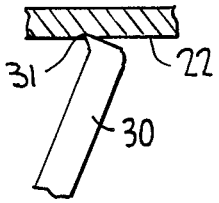
FIG. 4 is an enlarged view of the a portion of FIG. 3.
Figure 5:
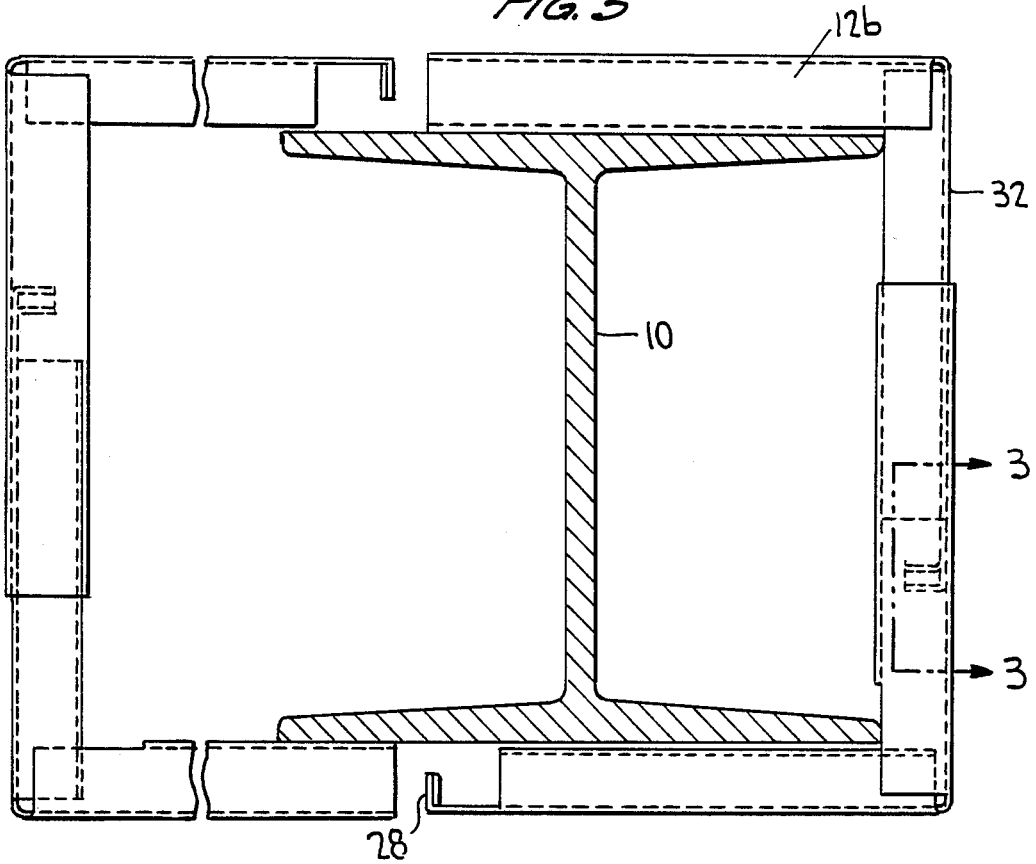
FIG. 5 is a sectional top view of a disengaged furring apparatus according to the present invention.
Figure 6:
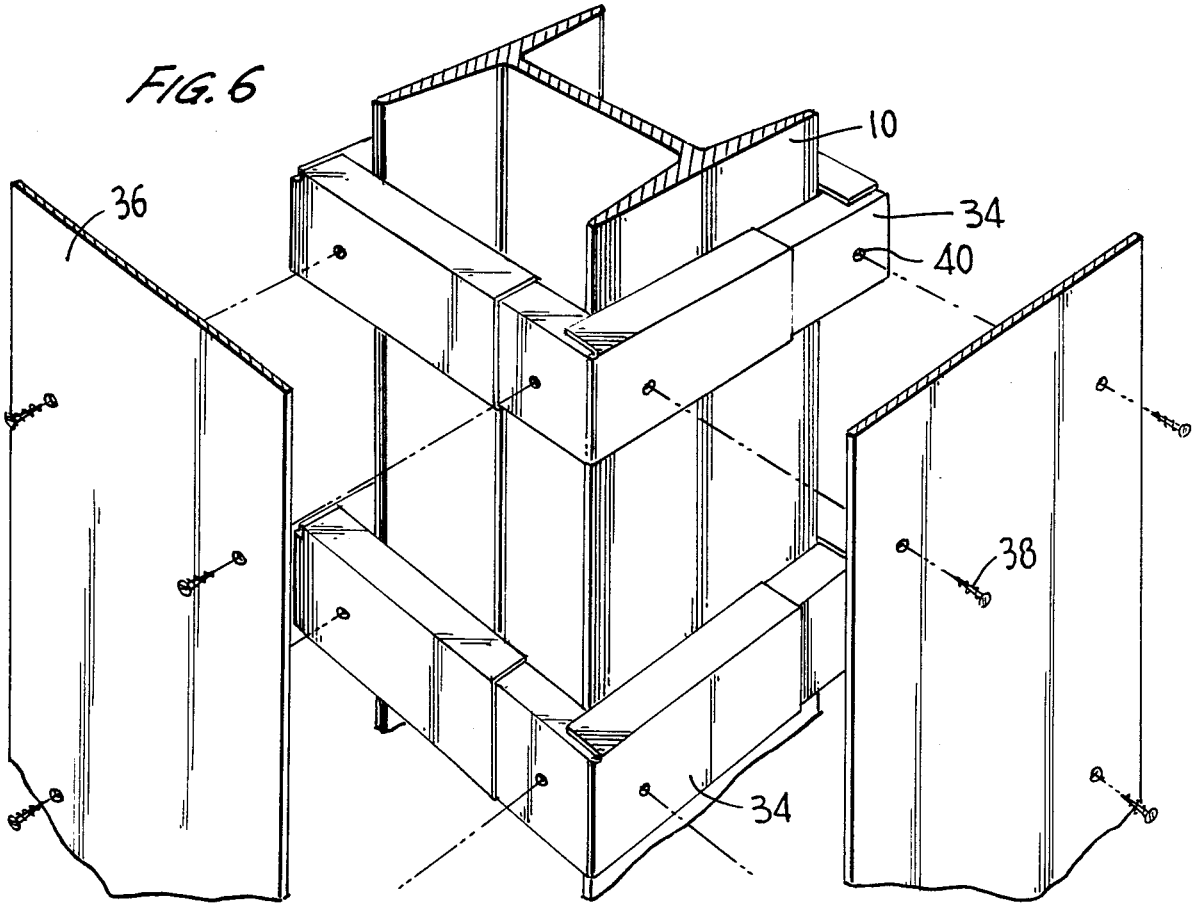
FIG. 6 is a perspective view of the engaged furring apparatus in use.

Referring now to FIGS. 3–5, a U-shaped member 32 is formed by engaging two L-shaped members 12*b*. Specifically, the first portion or leg 16 of a first L-shaped member 12*b* receives the second portion on leg 18 of a second L-shaped member 12*b*. Upon insertion, spring retainer 30 of the second L-shaped member engages the inner surface of channel 22 of the first L-shaped member. When the spring retainer is formed, the shearing burrs 31 are left on the retainer ends to aid in engaging the channel 22. The spring retainer is deformed as it travels within channel 22 of the first L-shaped member into an arcuate shape having a center of curvature opposite the direction of insertion. This deformation and the shearing burrs impede the disengagement of the two L-shaped members 12*b* and therefore serves to lock the L-shaped members together. The extent of insertion depends on the specific requirements for the length of the base of the U-shaped member 32, and may be performed manually and/or with the aid of a tapping tool such as a hammer.

In operation, a user starts with groups of four straight members 12*a*. After forming those into L-shaped members 12*b*, he then constructs groups of two U-shaped members 32 as discussed above. Of course, each U-shaped member has a first end with open ended channels 22 and a second end with a tongue 28 and spring retainer 30 since the two symmetrical L-shaped members 12*b* are engaged at opposite ends.

The user next places two U-shaped members 32 on opposite sides of a beam 10 in mirror image of one another, i.e., such that the first end of the first U-shaped member is aligned with the second end of the second U-shaped member and vice versa. The user then partially engages the aligned ends of the two U-shaped members 32 in a similar manner as the two L-shaped members **12*b* were engaged. The two U-shaped members 32 accordingly form a generally rectangular ring 34 about beam 10. After positioning the ring 34 at the desired location along beam 10, the user taps the corners of rectangular ring 34 in the direction of insertion to securely engage the respective ends of the two U-shaped members 32. Thus, ring 34 tightly encompasses column 10 and is secured thereto Next, the user repeats the foregoing steps to form and position a desired number of rectangular rings 34 on beam 10. This number is dependent on the height of the beam and the desired interval of support for wallboard 36. After positioning the desired number of rings, the user then positions the desired wallboard 36 flush against the outer surfaces of the rings 34. Next, the wallboard is secured to the rings via screws 38, which are preferably known and efficient self-tapping screws. These screws pass through holes 40 in the outer surface of the rings and terminate within the defined channels 22 and 26 after screwing is completed. Holes 40 may be prefabricated or created by screwing the screws 38**.

Accordingly, the present invention provides furring which is cheaply manufactured, quickly and easily installed, and allows the use of efficient power driven self-tapping screws. In addition, the adjustable engagement of the L-shaped and U-shaped members allows the present invention to be used with beams of widely varying dimensions.

Many modifications and improvements are possible. For example, the straight members may be bent to form more rounded L-shaped members to accommodate rounded beams and columns. The procedure would be similar to that discussed above except that the resulting rings would be more circular and tapping would occur closer to the point of engagement between the members. Thus, the present invention is easily adapted to use with a wide variety of beam configurations.

Further modifications and improvements will be apparent to one skilled in the art without departing from the spirit and scope of the present invention as defined by the following claims.

We claim:

1. A furring apparatus comprising:

a first generally U-shaped member having a first end, a second end, an inner face and a channel formed on its inner face;

a second generally U-shaped member having a first end, a second end, an inner face and a channel formed on its inner face;

means for engaging the first end of said first U-shaped member with the second end of said second U-shaped member;

means for engaging the first end of said first U-shaped member with the second end of first U-shaped member;

whereby said U-shaped members surround a column and the respective ends are engaged to form a ring which tightly encompasses the column; and means for securing wallboard to said U-shaped members, said securing means comprising screws which pass through the wallboard and through outer surfaces of said U-shaped members and into the channels of said U-shaped members.

2. A furring apparatus comprising:

a first generally U-shaped member have a first end, a second end, an inner face and a channel formed on its inner face;

a second generally U-shaped member having a first end, a second end, an inner face and a channel formed on its inner face;

means for engaging the first end of said first U-shaped member with the second end of said second U-shaped member; and means for engaging the first end of said second U-shaped member with the second end of said first U-shaped member, wherein the first ends of said U-shaped members are open and the second ends of said U-shaped members are equipped with spring retainers, and wherein said second ends are insertable within said first ends and the spring retainers engage the inner surfaces of the channels of the open first ends;

whereby said U-shaped members surround a column and the respective ends are engaged to form a ring which tightly encompasses the column.

3. The furring apparatus according to claim 2, wherein the spring retainers have two ends and a shearing burr located on each end.

4. The furring apparatus according to claim 2, wherein the spring retainers have two ends and a shearing burr located on each end.

5. The furring apparatus according to claim 2, wherein each of said first and second L-shaped members comprise an initially straight member having a bend line, whereby said straight member may be bent into said L-shaped member along the bend line.

6. A furring apparatus comprising:

a first generally U-shaped member have a first end, a second end, an inner face and a channel formed on its inner face;

a second generally U-shaped member having a first end, a second end, an inner face and a channel formed on its inner face;

means for engaging the first end of said first U-shaped member with the second end of said second U-shaped member; and means for engaging the first end of said second U-shaped member with the second end of said first U-shaped member;

wherein said first and second U-shaped members each comprise a first and second generally L-shaped member and means for engaging a leg of said first L-shaped member with a leg of said second L-shaped member; and wherein the leg of the first L-shaped member is open and the leg of said second L-shaped member is equipped with a spring retainer, wherein the leg of said second L-shaped member is insertable in the open leg of said first L-shaped member and the spring retainer engages the inner surface of the open leg;

whereby said U-shaped members surround a column and the respective ends are engaged to form a ring which tightly encompasses the column.

7. A method for apply furring to a column comprising the steps of:

providing a first U-shaped member having a first end, a second end, an inner face and a channel formed on its inner face;

providing a second U-shaped member having a first end, a second end, an inner face and a channel formed on its inner face;

engaging the first end of said first U-shaped member with the second end of said second U-shaped member; and engaging the first end of said second U-shaped member with the second end of said first U-shaped member, whereby said first and second U-shaped members form a rectangular ring which tightly encompasses the column;

wherein said first engaging step comprises inserting the second end of said second U-shaped member into the first end of said first U-shaped member and providing a spring retainer on the second end of said second U-shaped member.

8. The method according to claim 7, further comprising the step of securing wallboard to the rectangular ring.

9. The method according to claim 8, wherein said securing step comprises screwing the wallboard to the rectangular ring.

10. The method according to claim 9, wherein self-tapping power driven screws are used to perform said screwing.

11. The method according to claim 7, wherein said second engaging step comprises inserting the second end of said first U-shaped member into the first end of said second U-shaped member.

12. The method according to claim 11, further comprising providing a spring retainer on the second end of said first U-shaped member.

13. A method for apply furring to a column comprising the steps of:

providing a first U-shaped member having a first end, a second end, an inner face and a channel formed on its inner face;

providing a second U-shaped member having a first end, a second end, an inner face and a channel formed on its inner face;

engaging the first end of said first U-shaped member with the second end of said second U-shaped member; and engaging the first end of said second U-shaped member with the second end of said first U-shaped member, wherein providing the first U-shaped member includes providing two L-shaped members, and wherein engaging an end of one L-shaped member with an end of the other L-shaped members includes inserting the end of one L-shaped member into the end of the other L-shaped member, whereby said U-shaped members surround a column and the respective ends are engaged to form a ring which tightly encompasses the column.

14. The method according to claim 13, further comprising providing the end of one L-shaped member with a spring retainer.

15. The method according to claim 14, further comprising providing both ends of the spring retainer with shearing burrs.

16. The method according to claim 13, wherein providing two L-shaped members includes bending two straight members along a bend line.

17. The method according to claim 13, wherein providing the second U-shaped member includes providing two L-shaped members and engaging an end of one L-shaped member with an end of the other L-shaped member.

18. The method according to claim 17, wherein engaging the ends of the L-shaped members includes inserting the end of one L-shaped member into the end of the other L-shaped member.

19. The method according to claim 18, further comprising providing the end of one L-shaped member with a spring retainer.

20. The method according to claim 16, further comprising providing both ends of the spring retainer with shearing burrs.

21. The method according to claim 17, wherein providing two L-shaped members includes bending two straight members along a bend line.

* * * * *